United States Patent [19]

Caniglia

[11] 4,028,745

[45] June 14, 1977

[54] SANITARY SPRAY-DRY CLOSET SEAT

[76] Inventor: Joseph E. Caniglia, 5368 E. 134th St., Garfield Heights, Ohio 44125

[22] Filed: May 21, 1976

[21] Appl. No.: 688,886

[52] U.S. Cl. ..... 4/7

[51] Int. Cl.[2] ..... A47K 3/22; A47K 11/08

[58] Field of Search ..... 4/6, 7, 213

[56] References Cited

UNITED STATES PATENTS

| | | | |
|---|---|---|---|
| 2,344,561 | 3/1944 | Popil | 4/7 |
| 2,847,682 | 8/1958 | Shay | 4/213 |
| 2,875,450 | 3/1959 | Umann | 4/7 |
| 3,154,793 | 11/1964 | Congdon | 4/7 |
| 3,247,524 | 4/1966 | Umann | 4/7 |
| 3,469,267 | 9/1969 | Kuklok | 4/213 |
| 3,781,919 | 1/1974 | Ayala | 4/7 |
| 3,849,808 | 11/1974 | Olson et al. | 4/213 |

*Primary Examiner*—Henry K. Artis
*Attorney, Agent, or Firm*—Donnelly, Maky, Renner & Otto

[57] ABSTRACT

A sanitary spray-dry system has a liquid spraying outlet and an air directing outlet pivotably supported from a closet seat for movement from a stored out of the way location partially in the bowl to a use position for spraying warm liquid at the body of a person sitting on the seat for washing purposes and subsequently for blowing air at the washed area for drying the same. The system of the invention may conveniently be added to existing water closets generally between the bowl and seat thereof.

8 Claims, 4 Drawing Figures

SANITARY SPRAY-DRY CLOSET SEAT

BACKGROUND OF THE INVENTOR

The present invention relates generally to a washing and drying system for water closets and, more particularly, to such a system that may be added between the typical ceramic or like body of a water closet and the seat thereabove for washing and drying the body of a person using the water closet.

A typical water closet usually includes a bowl-like portion formed in a main body of ceramic or other material and a seat portion above the bowl and on which a person may sit. The seat is secured to the main body by a hinge connection, and several feet or spacers attached beneath the seat space the same above the bowl to locate the seat in a horizontal plane while the seat and bowl openings are aligned.

SUMMARY OF THE INVENTOR

The system of the present invention may be conveniently added to a water closet to wash and to dry the body of a user sitting on the seat of the water closet. Therefore, the needfor toilet tissue, which might block the drain system of the water closet when disposed therein, is eliminated, and the function thereof is provided in a more sanitary manner. Also, the system of the invention when installed in a water closet may be used to perform the functions of a typical bidet without requiring an additional fixture for which there often may not be sufficient space in a bathroom.

Accordingly, a primary object of the invention is to wash and to dry the body of a user after using a water closet.

Another object is to convert a typical water closet to one providing for the washing and drying of the body of the user.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in when the principles of the invention may be employed.

DESCRIPTION OF THE PREFERRED EMBODIMENT

Figure 1:
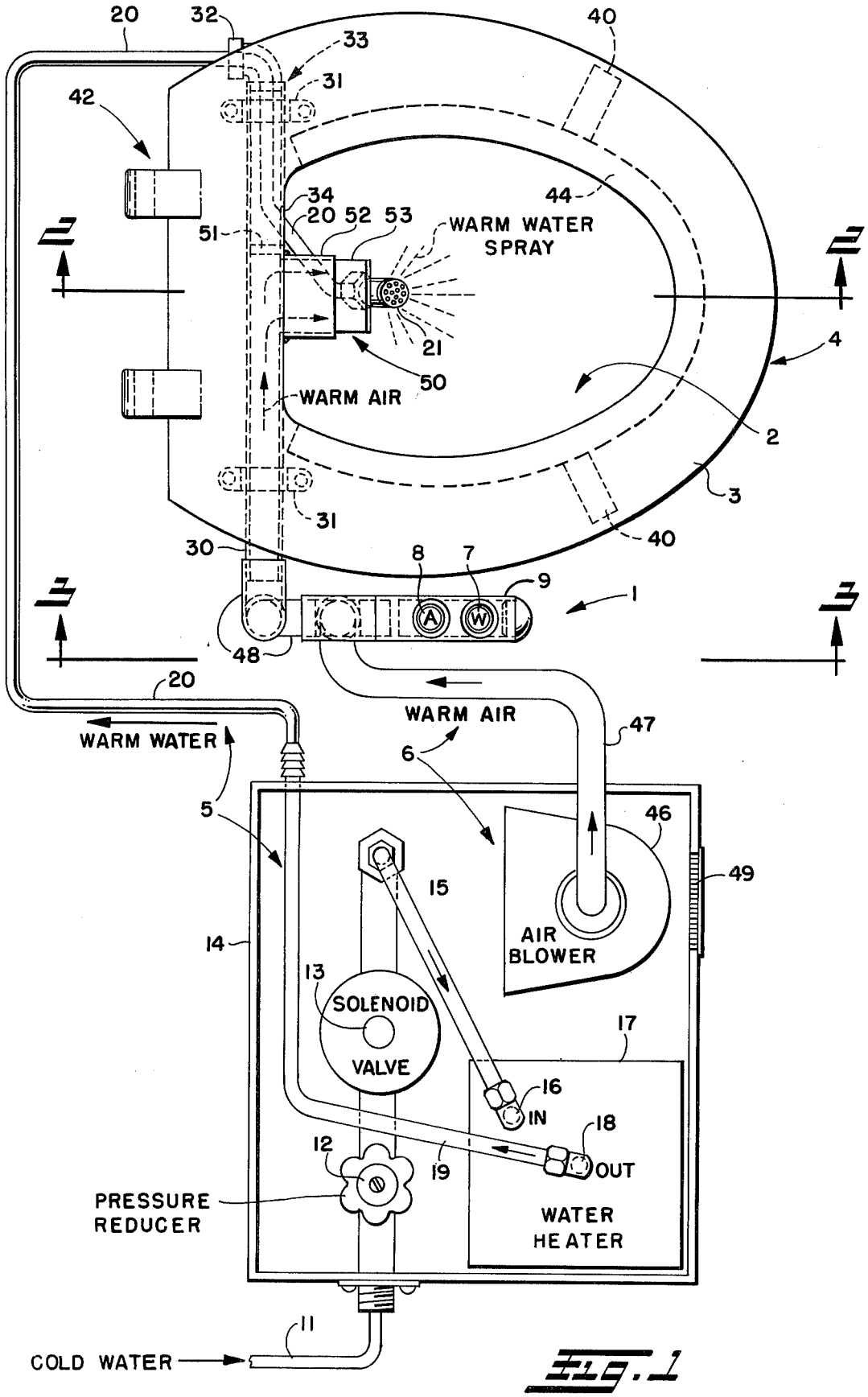
FIG. 1 is a plan view, partly in schematic form, of the spray-dry system of the invention coupled in relation to a typical seat used on a water closet.
Figure 2:
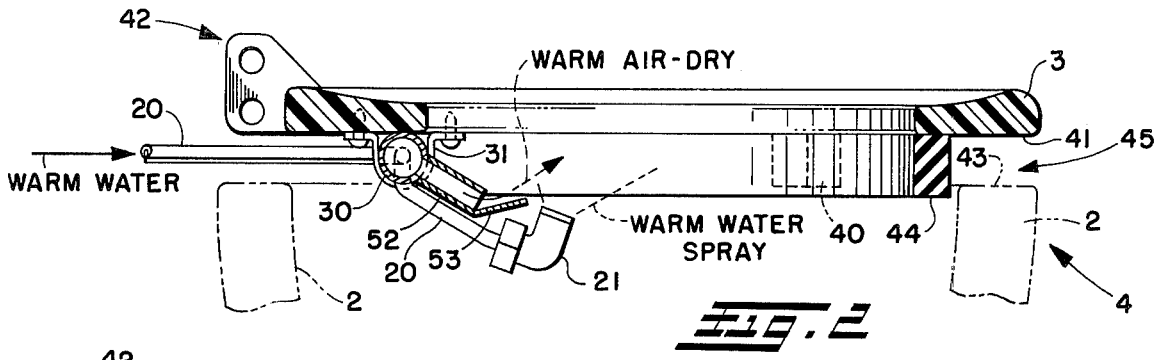
FIG. 2 is a section view of the system FIG. 1 looking generally in the direction of the arrows 2—2 thereof.
Figure 3:
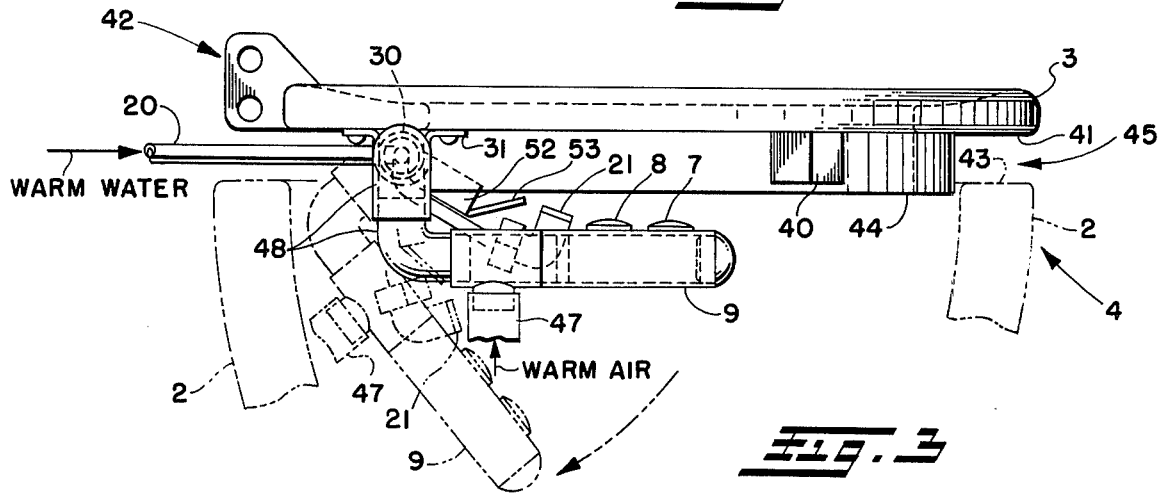
FIG. 3 is a section view of the system of FIG. 1 looking generally in the direction of the arrows 3—3 thereof.

Referring now more particularly to the drawings, wherein like reference numerals designate like parts in the several figures, and initially to FIGS. 1, 2 and 3, the sanitary spray-dry system 1 of the invention is illustrated in conjunction with the bowl-like portion 2, which is partly shown in phantom in FIGS. 2 and 3, and seat 3 of a conventional water closet 4. The system 1 includes a liquid washing portion 5 and and an air drying portion 6 that are selectively operated by a user, as described further below, by closing the wash control switch 7 or the dry control switch 8 which are located conveniently in a handle 9 and are electrically connected to the circuit 10 of FIG. 4.

The liquid washing portion 5 of the system 1 receives a cold water input from a water supply, not shown, such as the water supply coupled to the water closet, via a flow-line 11. Flow-line 11 is in turn coupled via a pressure reducer valve 12 and an electrically operated, normally closed solenoid valve 13, which are located in a supplementary housing 14 that may be positioned proximate the water closet. When the solenoid valve 13 is electrically energized, the reduced pressure water is provided via a line 15 to the input 16 of an electric hot water heater 17, which preferably would be energized in parallel with the solenoid valve 13, and the heated water from the water heater is coupled via its outlet 18 and the flow-line 19 to a flexible hose or equivalent flow-line 20 that directs the heated water flow to a liquid spraying outlet 21 located in the water closet 4.

Figure 4:
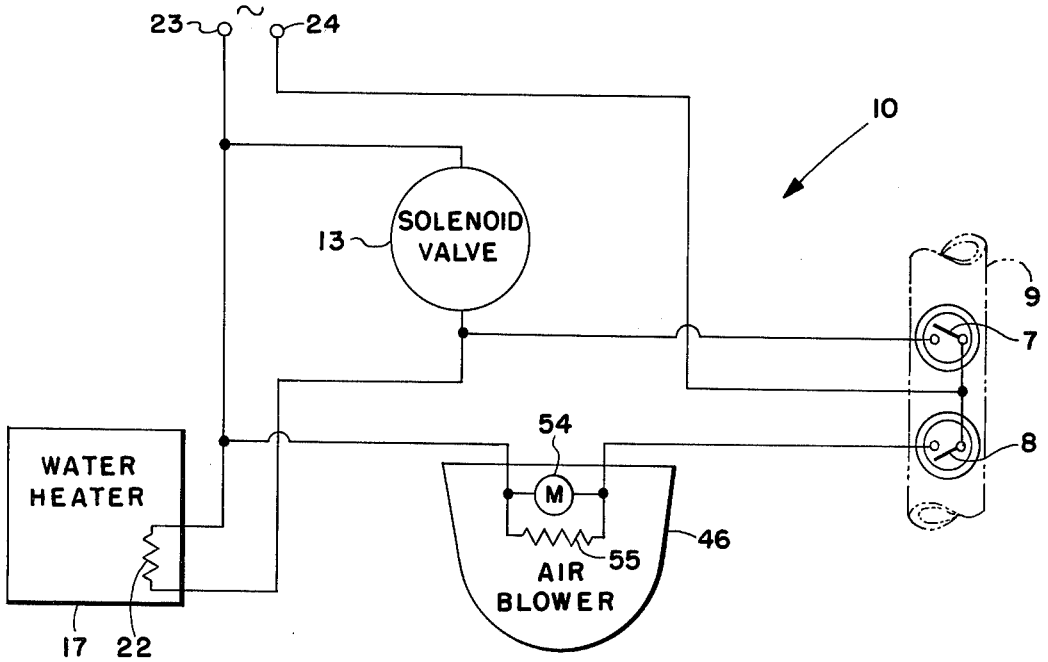
FIG. 4 is a schematic electric circuit diagram of a circuit for selective operation by a user to operate the system of FIG. 1.

As is illustrated in FIG. 4, the electric resistance heating element 22 of the water heater 17, which is preferably of the rapid or nearly instant type to supply promptly the desired warm water, and the solenoid valve 13 are electrically energized simultaneously with electric power provided on the terminals 23, 24 from a supply, not shown, by the user closing the wash push button switch 7 on the handle 9. Of course, other equivalent water heaters may be employed or, if desired, the system 1 may be coupled to the available hot water line, for example from the building hot water system.

A relatively rigid, elongate tubular member 30, for example plastic pipe or the like, is secured to the seat 3 by mounting brackets 31 for pivotable rotation about its own longitudinal axis. Stop means, not shown, may be provided on the tubular member 30 for cooperation with the respective mounting brackets to preclude lateral movement of the tubular member in the direction parallel to its longitudinal axis. An elbow connector 32 at one end 33 of the tubular member 30 directs the hose 20 into the tubular member, and an opening 34 in the tubular member directs the hose therefrom generally into the open volume of the bowl 2 to connection with the liquid spraying outlet 21.

The portion of the hose 20 extending through the opening 34 in the tubular member 30 may be sufficiently rigid to provide in cooperation with the wall of the tubular member circumscribing such opening the sole support of the liquid spraying outlet 21 or, alternatively, an additional support may be provided between the tubular member and the hose on the liquid spraying outlet so that the latter will be relatively fixedly supported with respect to the tubular member. The elbow 32 provides a measure of strain relief for the hose 20 to avoid causing a restriction of the latter when the tubular member 30 is pivoted about its longitudinal axis.

Several spacers or feet 40 are secured to the bottom surface 41 of the seat 3 to cooperate with the conventional hinge, a portion of which is indicated at 42, that couples the seat to the body of the bowl-like portion of the water closet, to space the seat above the top surface 43 of the bowl. A baffle or gasket 44, for example, of rubber, plastic or the like, also may be fastened to the bottom surface of the seat to block the escape of liquid through the space 45 between the bottom of the seat and the top of the bowl when the liquid washing portion 5 of the system 1 is operative.

In the air drying portion 6 of the system 1, an air flow is supplied by an air blower 46 in the supplementary housing 14 via air flow line 47 to handle 9, which is in fluid and mechanical connection via a pair of hollow elbows 48 with the tubular member 30. Therefore, air may be drawn into the supplementary housing 14 through a vent 49 by the blower 46 and delivered from the latter under a pressurized flow condition via the air flow line 47, the handle 9, the elbows 48, and the hollow interior of the tubular member 30 to an air directing outlet 50 that is located within the volume of the bowl 2. A stop 51 in the tubular member 30 blocks air from flowing along the tubular member beyond the air directing outlet 50.

The air directing outlet 50 preferably includes a duct-like portion 52, which is secured to the tubular member 30 and is in fluid connection with the hollow interior of the latter, and an air deflector 53, which deflects air flowing from the duct up toward the body of the user. The air blower 46 may be selectively electrically energized by the user who may press the air or dry push button switch 8 on the handle 9 to close an electrical connection in the circuit 10 that supplies electrical power form the terminals 23, 24 to the blower motor 54 schematically illustrated in FIG. 4. Moreover, the air blower 46 also may include an electric heater 55 energized in parallel with the motor 54 for warming the air before it is directed to the body of the user.

The liquid spraying outlet 21 and the air directing outlet 50 of the sanitary spray-dry system 1 normally would be rotated to a stored out of the way position within the bowl 2 of the water closet 4 by the user applying a downward force, as illustrated in FIG. 1 or a clock-wise rotational force relative to the illustrations of FIGS. 2 and 3, to the handle 9, thereby effecting rotation of the tubular member. However, when the user desires to use the sanitary spray-dry system 1 in accordance with the invention, the handle is rotated upwardly or counter clock-wise until the handle is a horizontal plane to align the liquid spraying outlet 21 and air directing outlet 50 with the user's body exposed within the opening of the seat 3. The elbow 32 may be employed as a stop reference to designate such horizontal position, or, if desired, additional stop means, not shown, may be employed on the tubular member, for example, for that purpose. The user then may effect selective energization of the liquid washing portion 5 by closing the switch 7 to energize that portion of the circuit 10 that energizes the solenoid valve 13 and the hot water heater 17, thereby to provide a warm water spray from the liquid spraying outlet 21 toward the exposed body portion of the user to wash the same. After completing the washing step by releasing the push button switch 7, the user may effect drying of the washed area by pressing the push button switch 8 to energize the drying portion 6 of the circuit 10 whereby the air blower 46 provides an air flow that is directed by the air directing outlet 50 toward the exposed body area of the user to dry the same.

Thus, it now will be clear that the sanitary spray-dry system 1 of the invention may conveniently be added to existing water closets generally between the bowl and seat thereof.

It will be appreciated that the various electrical and fluid circuits and element arrangements described in the above are presented for illustrative purposes and that equivalent arrangements may be employed in order to effect washing and drying of an exposed body area of a person sitting on the seat 3.

The embodiments of the invention in which an exclusive property or privilege is claimed are defined as follows:

1. For a water closet having a generally hollow bowl-like portion and a seat portion above said bowl-like portion, fastened thereto and on which a user may sit, the improvement of a system for washing and drying the body of such a user, comprising:

liquid supply means for supplying warm liquid to said system, liquid spraying means coupled to said liquid supply means for spraying warm liquid toward the body of such user for washing the same, air supply means for supplying a flow of air to said system, air directing means coupled to said air supply means for directing such flow of air toward the body of such user for drying the same, control means operable by such user for selectively controlling the spraying of such warm liquid and the flow of air respectively from said liquid spraying means and said air directing means, mounting means for pivotally mounting said liquid spraying means and said air directing means with respect to said water closet proximate the back portion of the bowl-like portion thereof for selective movement by such user between stored and use positions respectively out of alignment and into alignment with the body of such user, said mounting means including an elongated generally tubular member having a longitudinal axis and bracket means for mounting said tubular member between the bowl-like portion and the seat portion for rotation about such longitudinal axis, said tubular member having a hollow portion for coupling a flow of air from said air supply means to said air directing means, and said liquid spraying means and said air directing means being relatively fixedly supported by said tubular member for rotation therewith, and handle means coupled to said tubular member and exposed adjacent the side of the bowl-like portion for access by such user for selectively rotating said tubular member to move said liquid spraying means and said air directing means to such stored and use positions.

2. The improvement of claim 1, wherein said control means comprises normally open, selectively operable switches mounted in said handle means and accessible to such user.

3. The improvement of claim 1, wherein the bottom of said seat and top of said bowl-like portion define a space therebetween, and further comprising gasket means for blocking liquid flow from said liquid spraying means into said space.

4. The improvement of claim 1, wherein said air supply means comprises an air blower.

5. The improvement of claim 4, wherein said air supply means further comprises heater means for heating air delivered by said air blower to said air directing means.

6. The improvement of claim 1, wherein said liquid supply means comprises an electrically controllable valve and heater means for heating water delivered from said liquid supply means to said liquid spraying means.

7. The improvement of claim 6, wherein said control means comprises switch means mounted in said handle for energizing said electrical valve to pass water to said liquid water spraying means and for energizing said heater to heat such water.

8. The improvement of claim 7, wherein said air supply means comprises a blower and said control means further comprises a further switch means mounted in said handle for energizing said blower separately from said switch means for energizing said electrical valve.

* * * * *